United States Patent [19]

O'Brien et al.

[11] Patent Number: 4,641,779

[45] Date of Patent: Feb. 10, 1987

[54] CONCRETE GRADE CROSSING SYSTEM

[76] Inventors: Terrence X. O'Brien, 10513 Lake Steilacom Dr.; Dale E. McKennie, 10635 Lake Steilaccom Dr. South West, both of Tacoma, Wash. 98449

[21] Appl. No.: 609,488

[22] Filed: May 10, 1984

[51] Int. Cl.[4] ..... E01B 25/28

[52] U.S. Cl. ..... 238/7; 238/8; 238/152; 404/33

[58] Field of Search ..... 238/1, 7, 8, 327 R, 238/152, 154; 404/33, 49

[56] References Cited

U.S. PATENT DOCUMENTS

| | | | |
|---|---|---|---|
| 846,901 | 3/1907 | Bossert | 238/154 |
| 1,467,842 | 9/1923 | Daley et al. | 238/8 |
| 1,725,410 | 8/1929 | Muchnic | 238/8 |
| 3,317,137 | 5/1967 | Harmon | 238/8 |
| 4,210,281 | 7/1980 | Fee | 238/327 R |
| 4,232,822 | 11/1980 | Hahn et al. | 238/7 |
| 4,449,666 | 5/1984 | Hales et al. | 238/8 X |

FOREIGN PATENT DOCUMENTS

| | | | |
|---|---|---|---|
| 770824 | 5/1957 | United Kingdom | 238/8 |

*Primary Examiner*—Robert B. Reeves
*Assistant Examiner*—Glenn B. Foster
*Attorney, Agent, or Firm*—Dowrey & Cross

[57] ABSTRACT

A modular railway crossing structure supports a pair of rails. The modular railway crossing includes multiple base members, which are aligned axially along the length of the rails. The rails are encased by rubber boot elements. Each base member has a central recess formed in the upper surface. A pair of planar central rail locking members fit in the recess. The base members and the central rail locking members interrelate to support the rails.

1 Claim, 9 Drawing Figures

CONCRETE GRADE CROSSING SYSTEM

FIELD OF THE INVENTION

This invention relates to railroad crossing rail bed units useable for construction of railroad crossings for highways and other roads.

BRIEF DESCRIPTION OF THE PRIOR ART

Special preparation of the rail bed is necessary whenever a road crosses a rail bed at grade level. Generally such corssings are constructed such that the surface of the road is at approximately the same level as the upper surface of the rails. The recessed area between the rails and to either side thereof are built up to street level with the exception that recesses must be provided adjacent the upper portion of each rail to accomodate the flanges on railcar wheels.

This crossing construction has been accomplished in the past by filling the recessed area with materials such as wood or asphaltic paving materials. Cast-in-place and modular concrete crossing structures have also been used. Frequently, however, maintenance must be performed on these railroad crossings. This may be occasioned by the resurfacing of the street, the need to remove or replace the rails or the settling of the rail bed. With these types of railroad crossings such maintenance can be extremely expensive and labor intensive.

One type of railroad crossing avoids some of these difficulties by using a plurality of modular concrete sections to form the railroad crossing. These modular sections include a base portion which underlies and supports the two rails and which engages the outer sides of the rails. Two cast concrete interior panels are then placed between the rails and are bolted to the base member. A shim is placed between these two adjacent members to space them into contact with the inner sides of the rails. Holes are provided beneath these removeable members for working and tamping the ballast.

Although this solves many of the difficulties of the prior methods of making crossings, these modular units tended to chip away in the vicinity of the rail as heavily laden railcars pass over them. They also have a tendency to wear due to vibration of the rail and due to the contact between the concrete and rail, and produce a considerable amount of noise when traversed by a railcar. In addition, the rails tend to move longitudinally with respect to the modular members, which movement is commonly referred to as creeping. The interior panels between the rails must be removed to expose the tamping and jacking holes in order to work the underlying ballast. Signal wires must be routed around this type of railroad grade crossing.

SUMMARY OF THE INVENTION

The present invention provides a new modular railroad crossing bed unit and a method and apparatus for making such units. The rail bed unit of the present invention comprises a base member which is wider than the track, and two opposed center panels which are mirror images of one another. The base member has a central recess which is approximately as deep as standard rail and the walls of this recess are shaped to conform generally to the rail. The width of this central recess, of course, corresponds to the desired gauge of the railway.

The two center panels are designed to fill the remainder of the central recess in the base member and are placed in abutting relation in this recess. The outer edge of each member conforms to the profile of the rail in like manner to the walls of the recess in the base member. These central units are bolted in place to the base member to form a railroad crossing bed unit. A complete railway crossing is constructed by placing a plurality of such units in abutting end-to-end relation.

It has been discovered that abrasion between the steel rails and concrete can be eliminated and vibration and noise reduced by encasing the rails in a boot of elastomeric material which isolates the rails from the base and center panels. In addition, the use of such a boot results in the electrical isolation of the rails which reduced corrosion of the rails and signalization malfunctions which may otherwise result from stray currents. This boot may be made of an 80 to 85 Durometer ethylene-propelyene polymer. The boot covers the entire base of the rail as well as the webbing which extends upward from the base and thus also electrically isolates the rails. The upper portion of the rail on which the wheel bears, however, is not enclosed by the boot and the base member and central panels are recessed away from this exposed portion of the rail to prevent contact therewith.

The present invention also greatly simplifies leveling and raising of the railroad crossing bed units. Each unit includes a pair of cast in grouting connectors which permit the forcing of grout into the area beneath the base member. This allows quick and easy correction of problems resulting from subsidance of the underlying rail bed as well as raising of the bed unit to accomodate resurfacing of the road.

The rail bed units of the present invention are also configured to prevent creeping of the rails. For this purpose, special pockets are provided in each base member and central panel for receiving an anti-creeper clip. Longitudinal motion of the rails relative to the rail bed unit is resisted by contact between the clip and the walls of the pocket. Preferably, the upper, exposed surfaces of the base member and central panels are textured to provide a superior anti-skid surface.

The base member and center panels are manufactured by means of two novel forms. Each form is configured such that different gauges may be accomodated. Each form include provisions for mounting members such as the grout tubes and bolt tubes. Members are also provided for forming the anti-creeper cavities. Demountable toggles are used in the positioning of the walls of the form and foam seals are used to seal the form members. The surfaces of the forms are prepared to produce a non-skid upper surface on the rail bed unit.

Referring now to the drawings.

DETAILED DESCRIPTION OF THE PREFERRED EMBODIMENT

Figure 1:
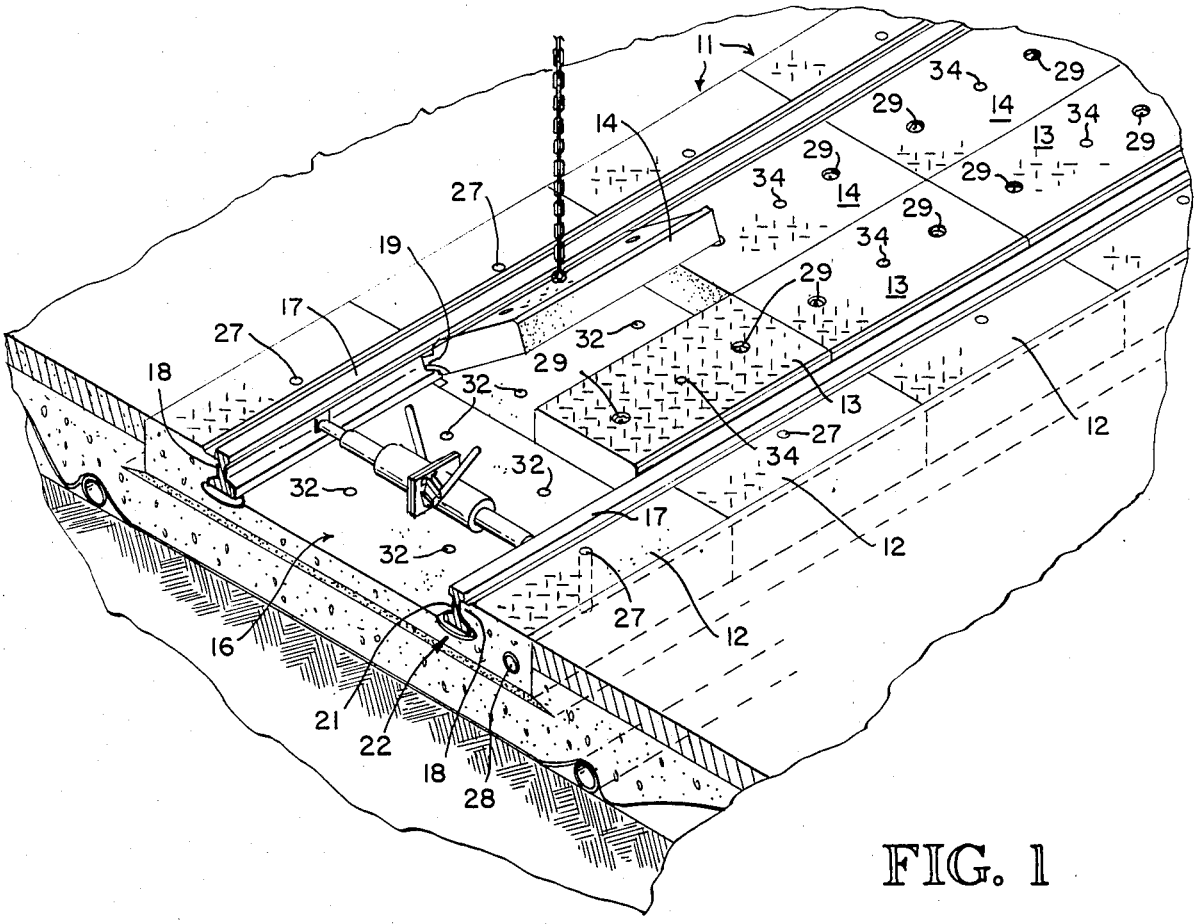
FIG. 1 is a perspective view of a partially completed railroad crossing according to the present invention.

As illustrated in FIG. 1, railroad crossing bed units 11 according to the present invention are suitable for use in making grade level railroad crossings. These individual bed units 11 may be placed in abutting relationship to form a crossing of any desired length. The crossing units 11 are thus suitable for making not only railroad crossings for roads and highways, but may also be used in industrial parks and parking areas where extended stretches of track must be traversed by cars or trucks.

Each bed unit 11 comprises a base member 12 and two center panels 13, 14. The base member 12 is substantially wider than the distance between the tracks and includes a central recess 16 for receiving the rails 17 and the center panels 13, 14.

Figure 2:
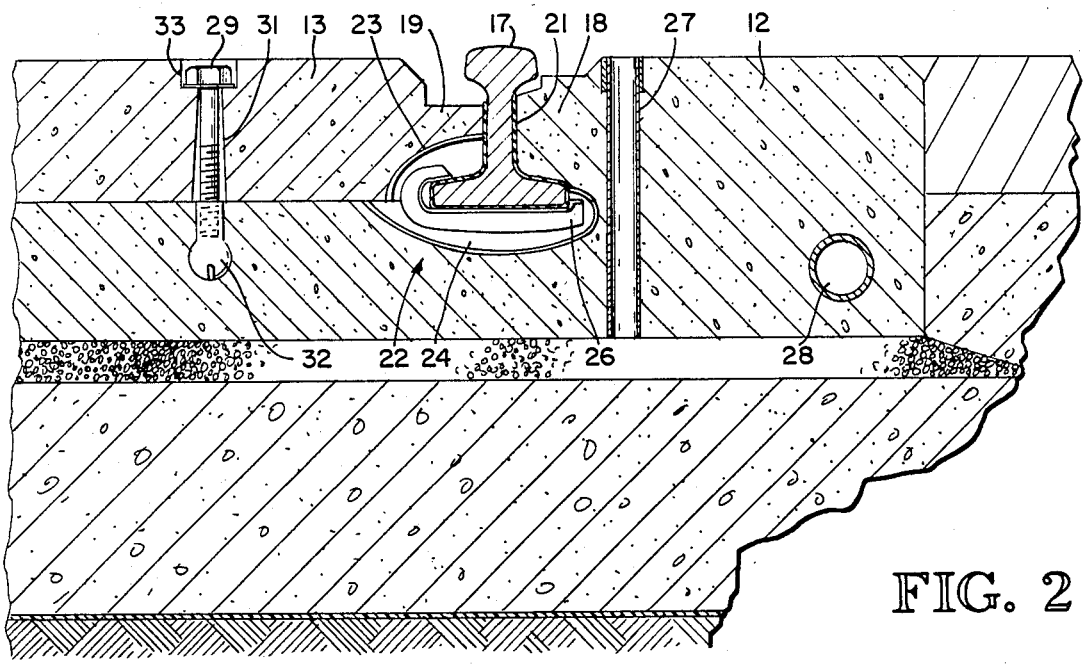
FIG. 2 is a cross-sectional view of the railroad crossing taken along lines 2—2 of FIG. 1.

As best shown in FIG. 2, the walls 18 of the base member 12 conform closely to the contour of the rails 17 with the exception that a space is left between the upper portion of the rail 17 and the wall 18 to prevent contact between the rail and the concrete base member 12. This reduces wear and chipping of the concrete and decreases the noise generated during traversal of the crossing by railcars. The outer edge 19 of the central panels 13, 14 likewise conforms to the contour of the rail but is recessed substantially below the upper portion of the rail 17 to accomodate the flange on the railcar wheels.

The remaining, lower portions of the rail 17, the web and base, are isolated from contact with the base member and central panels 13, 14 by a boot of elastomeric material 21. The boot 21 prevents abrasion of the concrete by the rail and damps vibration, and thus prevents wearing of the concrete and degradation of the crossing. The boot also insulates the rail, isolating it electrically from other rails. Preferably the boot 21 is made of a rubbery compound such as synthetic butyl rubber or EPDM and may be of 3/16 to ½ inches in thickness. The material used preferably has a Durometer of 80–85.

Still referring to FIG. 1 and 2, a pocket 22 is formed by recesses 23, 24 formed into the edges of the base member 12 and center panels 13, 14 respectively. This pocket 22 is designed to accomodate an anti-creeper clip 26 to prevent longitudinal movement of the rails 17 relative to the bed units 11. Each bed unit 11 also includes a pair of grout tubes 27 positioned adjacent respective edges of the base member 12 and extending completely therethrough. As best shown in FIG. 2, the upper end of the grout tube 27 is threaded to receive a grout nozzle. Grout can thus be introduced at elevated pressure below the base member 12 as necessary in order to level or raise the bed unit.

As illustrated in FIGS. 1 and 2, each base unit 12 further includes a section of signalization conduit 28 extending adjacent one edge of the base member 12 in generally parallel relation to the rail 17. Successive sections of signalization conduit 28 in successive base members 12 provide a passage for signal wires through the completed railroad crossing, eliminating the need for routing of the wires around or beneath the crossing.

The base members 12 and panels 13, 14 are held in place relative to one another by means of a plurality of bolts 29. These bolts extend through generally frustoconical tubes 31 in the panels 13, 14 and engage a concrete nut 32 embedded in the base member 12. A cylindrical cup 33 of greater diameter than the frustoconical portion of the tube is provided to recess the head of the bolt 29 below the surface of the center panels 13, 14 and to serve as a bearing surface for the head of the bolt 29. A concrete nut 34 is provided approximately at the center of mass of each of the panels 13, 14 for attaching a lifting chain thereto.

As best illustrated in FIG. 1, the base member 12 and center panels 13, 14 are preferably formed with a cross-hatched surface texture. This irregular surface enhances the traction of vehicles traversing the crossing. In addition, the exposed edges of these upper surfaces are beveled to reduce cracking and chipping thereof.

In practice, a railroad crossing is constructed using the bed units of the present invention as follows. A rail bed sub-surface is first prepared in a conventional manner and successive base members 12 are disposed in abutting end-to-end relation therealong. Rails 17, encased in elastomeric boots 21, are then positioned in the central recess 16 of the base members 12 adjacent the walls 18 thereof. Anti-creeper clips 26 are installed on the rails 17 as desired at locations corresponding to the pockets 22. Commencing at one end of the crossing, pairs of center panels 13, 14 are lifted by the centrally located concrete nuts 34 and positioned over the central recess 16 in the base member 12. The rails are then pressed into engagement with the walls 18 of the central recess 16 for example by means of a jack or jacks 36. The center panels 13, 14 are then lowered until their outer edges are brought into contact with the boot rail 21 which encases the lower portion of the rail 17. In this position, as illustrated in FIG. 1 (shown only with respect to a single panel 14) the inner edge of the center panels 13, 14 are raised above the base member. These panels 13, 14 are then lowered simultaneously to wedge the rails into place. In order to prevent relative movement of the center panels 13, 14 and base member 12, bolts 29 are used to firmly fasten the center panels 13, 14 in place in the central recess 16 of the base member 12.

The base members 12 and center panels 13, 14 of which each bed unit 11 is made can be manufactured quickly and inexpensively using the system of forms illustrated in FIGS. 3–9. Only a single set of such forms is needed to make the center panels 13, 14 and base members 12 for various gauges of track.

Figure 3:
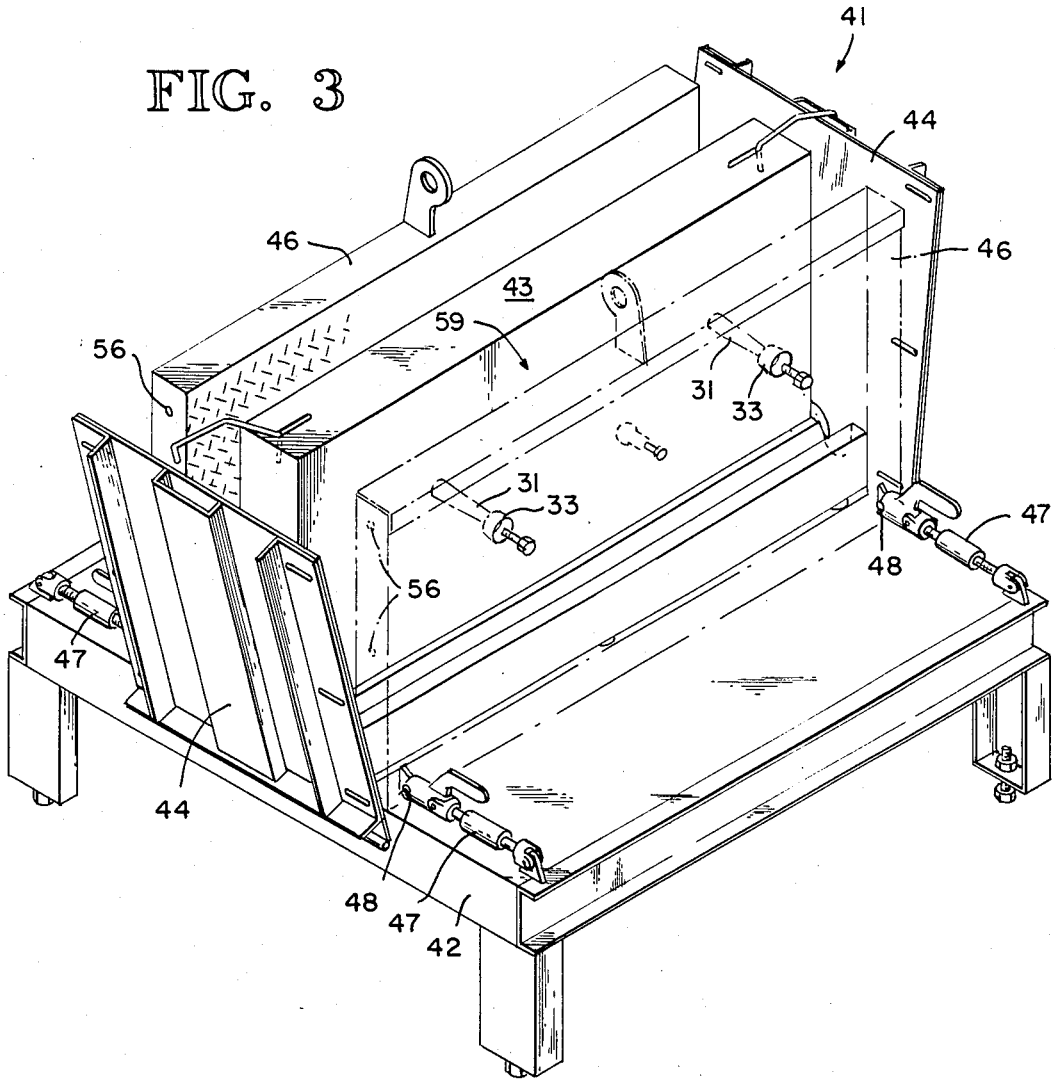
FIG. 3 is a perspective view of a form for making center panels according to the present invention with certain parts shown in phantom.
Figure 4:
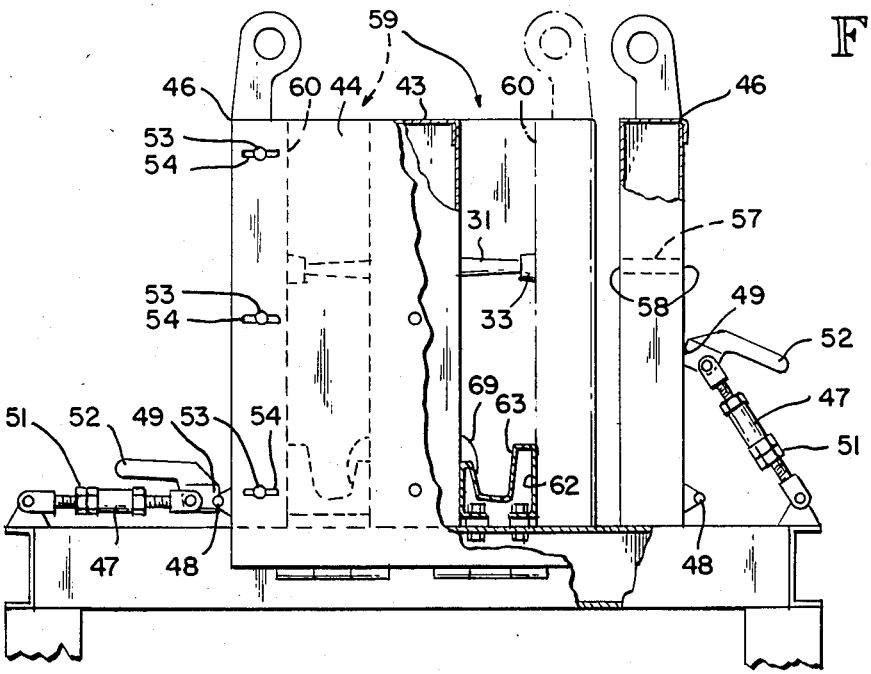
FIG. 4 is a cross-sectional view of the form taken along lines 4—4 of FIG. 3 with certain parts broken away.
Figure 5:
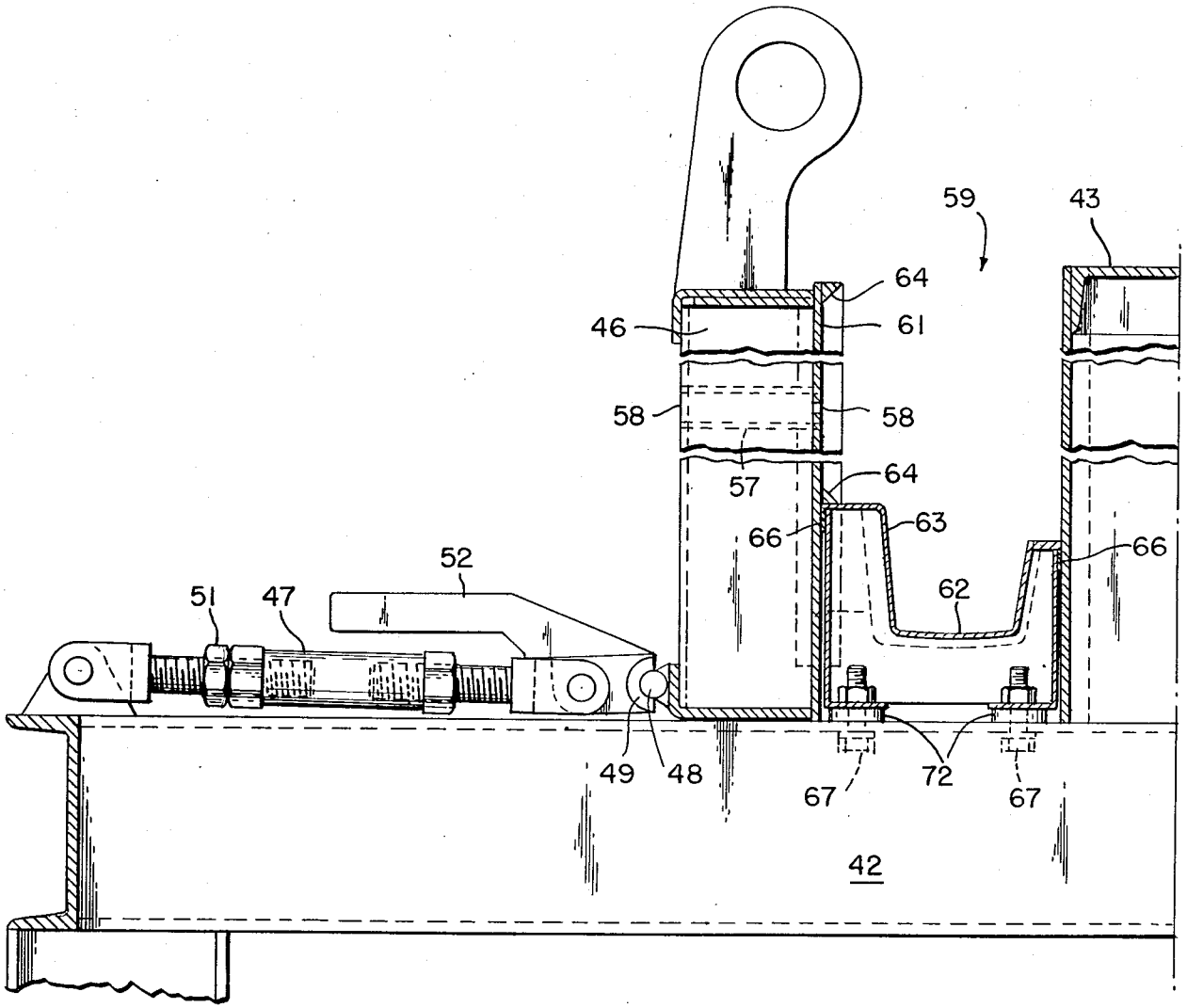
FIG. 5 is a partial cross-sectional view of the form of FIG. 4.

As best illustrated in FIGS. 3–5, the form 41 for making the center panels 13, 14 is designed to produce two panels 13, 14 at a time. The form 41 includes a base 42. The center section 43 of the form 41 rests on the base 42 and projects upwardly therefrom. The center section 43 is enclosed by two end panels 44 which are hinged to the base 42, and by a pair of side panels 46 which extend transversely across the base 42.

As best illustrated in FIG. 4, the side panels 46 are not connected to the base but rather are positioned by toggle locking turnbuckles 47 which are pivotally mounted at the corners of the base 42. These turnbuckles 47 engage horizontally extending pins 48 which are mounted adjacent the corners of the side panels 46 at their bases by means of a yoke 49 formed in the free end of the turnbuckle 47. The turnbuckle 47 is adjustable in length and is fixed at a desired length by means of a jam nut 51. The turnbuckle also includes a pivotally connected handle 52 which mounts the yoke 49 and which is depressed to lock the side panel 46 in position.

As illustrated in FIG. 4, the side panels 46 are also maintained in place by bolts 53 which extend through slots 54 in the end panels 44. The bolts 53 are held in place by nuts welded to the side panels 46 and accessed through apertures 56 in the ends of the side panels 46.

As best shown in FIGS. 4 and 5, the side panels 46 are of double wall construction. Three tubes 57 extended between the walls of each side panel 46 and communicate with holes 58 in the side walls 55 of the side panel so that bolts can be extended through the side panel 46 into the cavity 59 formed between the center section 43 and side panel 46. As illustrated in FIG. 3, these bolts are used to support a concrete nut 34 positioned generally at the center of mass of the panel and used to lift the panel into place. The bolts also support a pair of tubes 31 through which the hold-down bolts 29 for the central panels 13, 14 extend. The inner wall 61 of the side panels 46 may be cross-hatched to provide an irregular non-skid surface on the upper surface of the central panels 13, 14.

Referring next to FIGS. 3–5, the bottom of the cavity 59 formed between the center section 43 and side panels 46 contains a metal former 62. As best illustrated in FIG. 5, this former 62 conforms generally to the cross-sectional contour of a rail 17, with the exception that clearance is provided to allow encasing the lower portions of the rail in an elastomeric boot 21 as illustrated in FIGS. 1 and 2. In addition, one portion 63 of the former 62 is adapted to provide a recess for a railcar wheel flange and to provide clearance between the upper portion of the rail and the center panel 13.

A strip of material of triangular cross section 64 is fastened to the former 62 and extends along its length in abutting relation to the inner wall 61 of the side panel 46. A corresponding strip 64 is fastened to the interior side wall 65 of side panel 46 along its upper edge. These strips form beveled edges at the exposed upper corners of the panels 13, 14. Foam gaskets 69 are positioned between the former 66 and the central section 43 and side panels 46 to effect a seal there between. The former 62 is maintained in position in the cavity 59 by bolts 67 which mount it to the base 42. Spacers 68 may be positioned between the former 66 at the upper surface of the base 42 to extend former upwardly into the caity 59 as desired.

As best illustrated in FIGS. 3 and 4, a plug 69 is positioned adjacent the former 62 and end panels 44 to produce part of the pocket 22 used to accomodate an anti-creeper clip 26 for maintaining the rail 17 in position. As shown in FIGS. 1 and 2, this recess 24 cooperates with a recessed 23 in the base member 12 to form the pocket for the anti-creeper clip 26.

Referring to FIGS. 3–5, center panels 13, 14 of the kind illustrated in FIGS. 1 and 2 are manufactured in the form 41. The foam is first prepared by bolting the former 62 to the base 42 using spacers 68 as desired to position it vertically relative to the base and the concrete nuts 34 and tubes 31 for the center panel hold down bolts 29 are bolted in place on the side panels 46. The side panels 46 are then moved into position in contact with the metal former 62 and pushed into engagement with the former by action of the toggle locking clamps 47, compressing the gaskets 66. The end panels are then pivoted up into position and bolted to the side panels 46 and the plugs 69 are then positioned in abutting relation with the side panels 46 and formers 62. Reinforcing rod or other metallic concrete reinforcement may be positioned in the form 41 either before or after the side and end panels 44, 46 are positioned and bolted together. Concrete is then poured into the form and allowed to harden. The bolts holding the concrete nut and hold down bolt tubes are then removed and the concrete outer panels with the nuts 34 and bolt tubes 28 in place are then ready for use.

The width of the panel 13, 14 and hence the gauge of the track with which the panel is to be used may be altered as illustrated in FIG. 5 by removal of or insertion of spacers 72 between the bottom of the former 66 and the base 42. The width of the central recess 16 in base member 12, of course, must also be adjusted to accomodate such a change in the width of the panels 13, 14.

Figure 6:
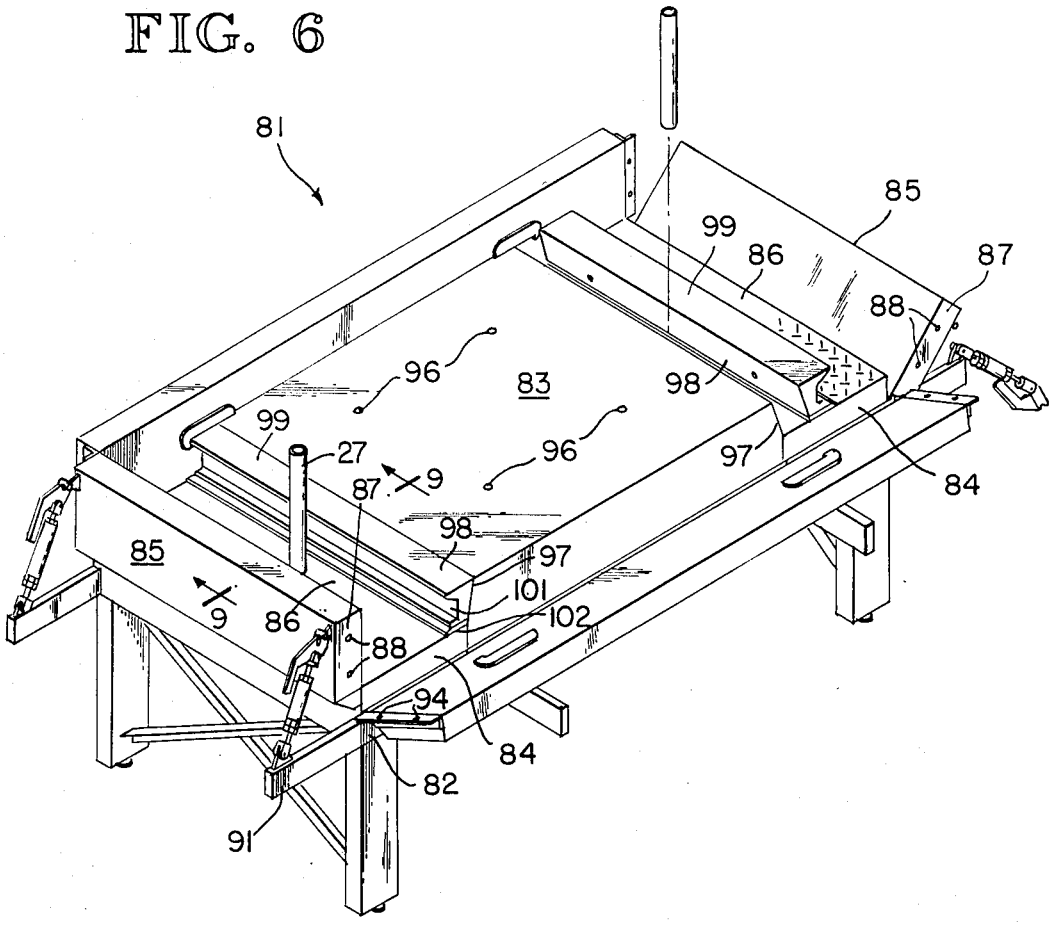
FIG. 6 is a partially exploded perspective view of a form for making base members according to the present invention.
Figure 7:
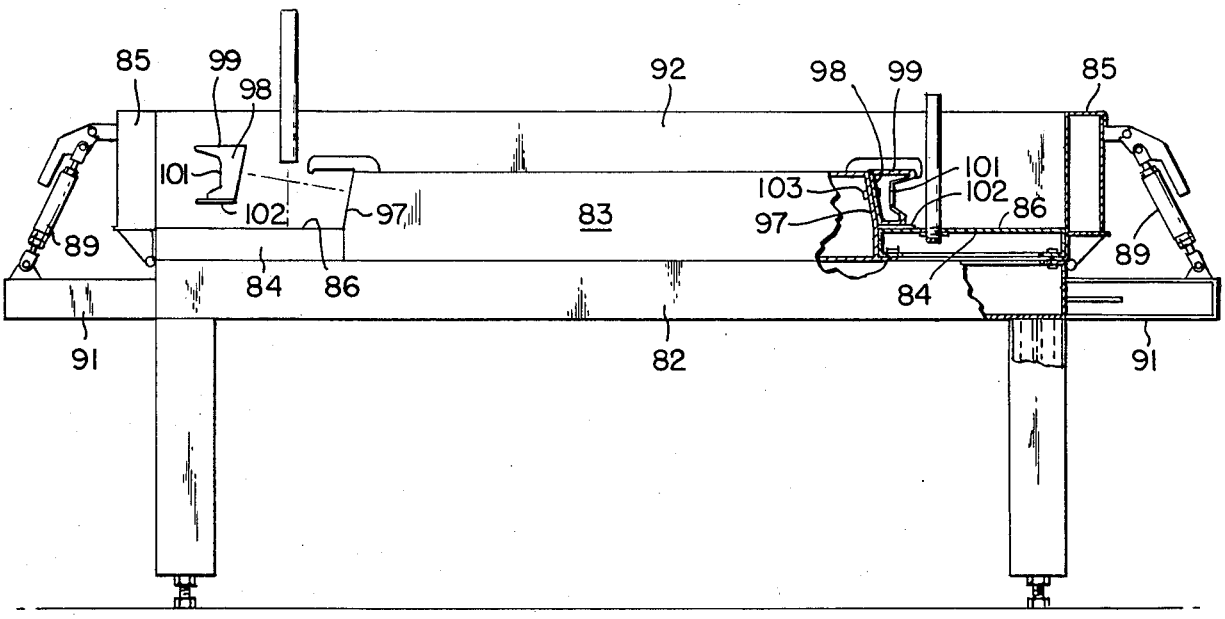
FIG. 7 is a partially exploded side elevation of the form of FIG. 6 with certain parts broken away.

As best illustrated in FIGS. 6 and 7 and form 81 in which the base member 12 is made comprises a base 82 on which a raised central member 83 is mounted. This central member 83 forms the central recess 16 in the base member 12, as shown in FIG. 1, and is abutted by floor members 84 on either side. Two opposed end panels 85 are hinged to the base 82 of the form 81 at a location below the upper surface 86 of the floor member 84. These end panels 85 are of hollow, box-like construction and are closed off at their ends by plates 87. Each end plate 87 is formed with two apertures 88 extending therethrough. A nut is welded to the inner surface of each end plate 87, positioned to receive a bolt through the apertures 88. A pair of toggle locking turnbuckles 89 are provided to support each end panel 85 in an upright position. These turnbuckles 89 extended upwardly at an angle from the support 91 which extend horizontally from the base 82.

A pair of side panels 92 are likewise hinged to the base 82. The side panels 92 are of generally box-like construction and each include a pair of brackets 93 one of which is mounted at each end of the side panel 92 with its inner surface co-planer with the inner surface of the side panel 92. Each of these brackets 93 includes two apertures 94 which correspond to the apertures 88 in the end plates 87.

Figure 8:
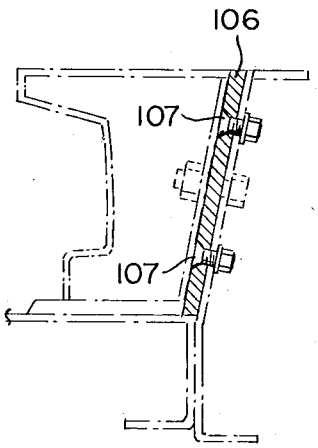
FIG. 8 is a partial cross-sectional view of an alternate embodiment of the form taken along line 8—8 of FIG. 6.
Figure 9:
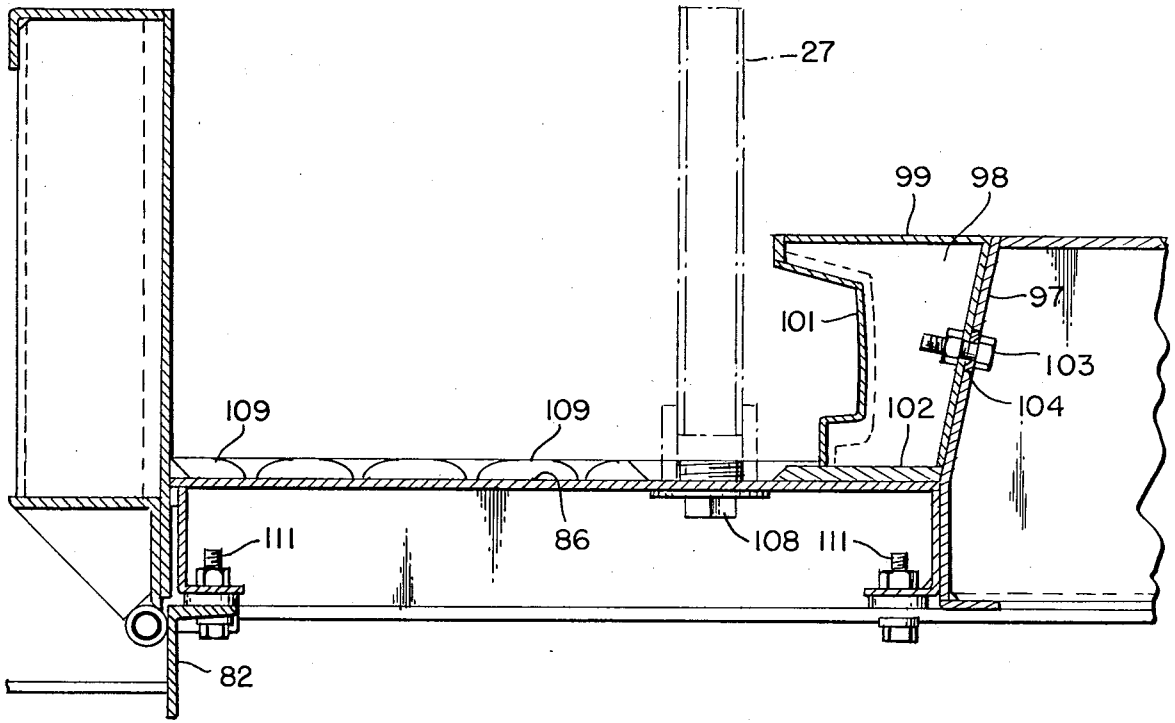
FIG. 9 is a partial cross-sectional view of the form taken along line 9—9 of FIG. 6.

The raised central member 83 mounted on the base 82 includes a plurality of apertures 96 for locating the concrete nuts 32, shown in FIGS. 1 and 2 which cooperate with the bolts 29 to hold the base member 12 and center panels 13, 14 in place. These nuts 32 are bolted in place to the central member 83 by bolts extending through the apertures 94. As best illustrated in FIGS. 7, 8 and 9, the sides 97 of the central member 83 are inclined. Formers 98 having a corresponding inclined surfaces, are mounted to the sides of the central member. As best shown in FIG. 9, this former 98 includes an upper surface 99 which is flush with the upper surface of the central member 83 when the former 98 is bolted in place. A contoured side portion 101 is provided for molding a contoured surface into base members produced using the form 82. The shape of this surface 101 corresponds generally to the shape of a rail 17 with allowance made for the provision of an elastomeric boot 21 on the rail and with either provided around the upper portion of the rail to prevent contact between the concrete and the rail.

The former 98 further includes a base plate 102 which extends outwardly from the contoured side member 101. The former 98 is maintained in position by bolts 103 inserted through vertically extending slots 104 in the sides 97 of the central member 83 of the base 82. Nuts welded to the interior of the former 98 secure these bolt 103 in position.

Referring to FIG. 8, the gauge of the base members 12 may be adjusted to different widths by use of a shim plate 106. The plate 106 is positioned between the former 98 and the adjacent end 97 of the central portion 83 and is maintained in place by bolts 107 which are countersunk into the shim plate 106 and extend through apertures in the sides 97 of the central member 83. The slots 104 in the ends 97 of the central member 83 extend vertically a sufficent distance to accomodate the vertical offset of the bolts 103 caused by use of the shim plate 106. Referring again to FIG. 9, the grout tubes 32 are mounted in the form 81 by means of a threaded plug which extends through the upper surface 86 of the floor members 84. The threaded end of this plug engages the threads on the interior of the grout tube 27 to maintain it in position.

A non-skid surface is formed into the exposed upper surfaces of the base member 12 by the cross-hatching 109 on the surface 86. A special surface may, however, be provided on the base member 12 as desired using the form of the present invention. In order to accomplish this, it is necessary only to remove the raised floor member 84 by detaching the bolts 111 holding them in place. New floor members 84 having the desired upper surface can then be mounted to the base 82.

Base members are made in an inverted position using the form 81 illustrated in FIGS. 6–9. As shown, the formers 98 are positioned atop the floor members 84 and bolted in place. Grout tubes 29 are then bolted to the floor members 84 by means of plugs 108 which extend upwardly through the flooring member 84 to engage threads in the grout tube 29. Concrete nuts 32 are then fastened to the upper surface of the central member 83 by bolts extended through the apertures 96. The end panels 85 are then moved to their upright position and locked in place by the turnbuckles 91. The side panels 92 are then raised in turn and bolted to the end panels 84 and plugs 112 are inserted in abutting relation with the side panels 92 and formers 98. These plugs form a recess 23 in the base member 12 which cooperates with a recess 24 in an overlying center panel 13, 14 to form a packet 22 which receives an anti-creeper clip 26 as shown in FIG. 2. Reinforcing materials such as reinforcing rod are then positioned in the form 81 and the form 81 is filled with concrete.

Once the concrete has hardened, the plugs 108 are removed, the side and end panels disengaged and pivoted downward and the bolts holding the formers 98 in place are removed. The base member may then be removed from the form 81, and the formers 98 disengaged therefrom.

What is claimed is:

1. A method for making a railway crossing comprising positioning a plurality of base members end to end on a prepared rail bed, each of said base members being formed with a central recess extending between the transverse edges thereof and defining parallel walls of said central recess each being formed to conform generally to the shape of the outer surface of a rail;

providing a pair of rails, each having its base and web portions encased in a boot of elastomeric material;

positioning the boot-encased rails in the central recesses of the plurality of base members respectively abutting the walls of the central recesses;

positioning pairs of generally planar central rail-locking panels in abutting relation with the central recesses of the base members between the rails, one pair after another such that each pair is aligned with a base member, and forcing the boot-encased rails apart thereby compressing the elastomeric boots to enable the rail-locking panels to sit on the bottoms of said central recesses such that the boot-encased rails are forced into engagement with the respectively associated walls of the central recesses and the central panels; and fastening the center panels to the base members such that the boot-encased rails are wedged into their proper positions.

* * * * *